US007735840B2

(12) United States Patent
Wilborn

(10) Patent No.: US 7,735,840 B2
(45) Date of Patent: Jun. 15, 2010

(54) ROLLER SHOE

(75) Inventor: Donald Wilborn, Nokomis, FL (US)

(73) Assignee: BBC International LLC, Boca Raton, FL (US)

( * ) Notice: Subject to any disclaimer, the term of this patent is extended or adjusted under 35 U.S.C. 154(b) by 80 days.

(21) Appl. No.: 11/832,977

(22) Filed: Aug. 2, 2007

(65) Prior Publication Data

US 2009/0033046 A1 Feb. 5, 2009

(51) Int. Cl.
*A63C 17/18* (2006.01)

(52) U.S. Cl. ..... 280/7.12; 280/7.13; 280/11.27

(58) Field of Classification Search ..... 280/7.13, 280/7.1, 841, 8, 13, 7.12, 1.188, 9, 30, 87.01, 280/200, 11.27
See application file for complete search history.

(56) References Cited

U.S. PATENT DOCUMENTS 1,811,532 A * 6/1931 Benetatos ..... 280/843
1,984,989 A * 12/1934 Reed ..... 280/7.13
3,306,623 A * 2/1967 Weitzner ..... 280/11.206
3,351,353 A * 11/1967 Weitzner ..... 280/7.13
3,793,571 A 2/1974 Janssen
3,884,485 A 5/1975 Walle
3,979,842 A 9/1976 Texidor
3,983,643 A 10/1976 Schreyer et al.
4,150,499 A 4/1979 Wang
4,333,249 A 6/1982 Schaefer
4,355,474 A 10/1982 Grim
4,363,502 A * 12/1982 Bakerman ..... 280/816
5,785,327 A 7/1998 Gallant
5,797,609 A 8/1998 Fichepain
5,887,898 A 3/1999 Petrosino
5,927,729 A 7/1999 Di Filippo et al.
6,042,125 A 3/2000 Wu
6,120,038 A 9/2000 Dong et al.
6,398,237 B1 6/2002 Attey
6,474,661 B1 11/2002 Chang
6,523,836 B1 2/2003 Chang et al.
6,634,656 B1 10/2003 Gervasoni
6,702,304 B2 3/2004 Chu
6,729,629 B2 5/2004 Chi
6,736,411 B2 5/2004 Wang et al.
6,742,788 B1 6/2004 Li et al.
7,195,251 B2 * 3/2007 Walker ..... 280/11.19
7,204,330 B1 4/2007 Lauren
7,407,167 B1 * 8/2008 Chou ..... 280/7.13
7,497,446 B2 * 3/2009 Yang ..... 280/11.27
2003/0141680 A1 7/2003 Clark et al.
2003/0201614 A1 10/2003 Chi
2004/0007835 A1 1/2004 Yang
2006/0108754 A1 5/2006 Yan

FOREIGN PATENT DOCUMENTS

CA 2 181 212 A1 3/1997
EP 0 243 560 A1 11/1987
GB 2 068 739 A 8/1981
WO 2004/011110 A1 2/2004

* cited by examiner

*Primary Examiner*—Hau V Phan
(74) *Attorney, Agent, or Firm*—GrayRobinson, P.A.

(57) ABSTRACT

This invention is directed to a roller shoe having a pair of rollers connected together by a strap which may be converted to a walking or running shoe by removing the rollers and strap as a unit from the outsole of the shoe.

9 Claims, 5 Drawing Sheets

ROLLER SHOE

FIELD OF THE INVENTION

This invention relates to footwear, and, more particularly, to an article of footwear having an outsole formed with a cavity in the toe area and a cavity in the heel area each of which receive a roller connected together by a strap so that the rollers may be removed as a unit from the outsole to convert the shoe from a roller shoe to a walking or running shoe.

BACKGROUND OF THE INVENTION

Traditional roller skates, and more recently, inline roller skates, are popular among children and adults alike. While originally intended for roller rinks and the like, modern roller skates commonly employ rollers with a rubber-like covering which permit them to be used on roadways, sidewalks and other outdoor surfaces. One issue with these types of roller skates is that they may only be used for skating. If an individual is using the roller skates outdoors, he or she must either carry a pair of walking or running shoes, or return home, when finished skating because its is difficult to walk around in such skates.

This problem has been addressed at least to some extent in the prior art. In one design, the outsole of a shoe is formed with one or more cavities which receive rollers capable of moving between an extended position in contact with the ground or other surface and a retracted position inside of the outsole. See, for example, U.S. Pat. Nos. 6,474,661; 6,523,836; 5,797,609 and 5,785,327. These types of shoes may be used as a roller skate with the rollers extended, but can function as a walking or running shoe by retracting the rollers within the cavities. This versatility provides an advantage over traditional roller skates or inline skates, but also creates problems. In particular, shoes of this type are relatively heavy when worn as a walking or running shoe due to the presence of multiple rollers in the shoe outsole. Additionally, the outsole must be made relatively thick to receive the entirety of the rollers when in the retracted position which adds weight to the shoes and detracts from their aesthetic appearance.

Another approach in the prior art is to provide a shoe with a detachable skate. For example, U.S. Pat. Nos. 6,736,411 and 6,120,038 disclose shoes which may be releasably attached to an inline roller assembly to covert the shoe from a conventional walking or running shoe to a roller skate. U.S. Pat. Nos. 6,729,629 and 6,702,304 teach the combination of a shoe and a roller base having a platform with a pair of rollers at either end. The shoes of these two patents may be releasably attached to the roller base, and detached, depending on whether they are to be used as roller skates or walking shoes. Limitations with both of these designs include the fact that both the inline roller assembly and the roller base are relatively cumbersome to attach and detach from the shoe, and they are inconvenient and heavy to carry around after conversion from a roller skate to a walking shoe.

SUMMARY OF THE INVENTION

This invention is directed to a roller shoe having a pair of rollers connected together by a strap which may be converted to a walking or running shoe by removing the rollers and strap as a unit from the outsole of the shoe.

In the presently preferred embodiment, the outsole of the shoe is formed with a cavity in the toe area and a second cavity in the heel area with a recess extending along the outsole in between the two cavities. Each cavity releasably mounts a roller, and the two rollers are connected together by a strap which is received within the recess. The shoe may be converted to a walking or running shoe by removing the two rollers and the strap as a unit from their respective cavities and recess, and then preferably covering at least the cavities with a cap to prevent the accumulation of dirt or other debris therein.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
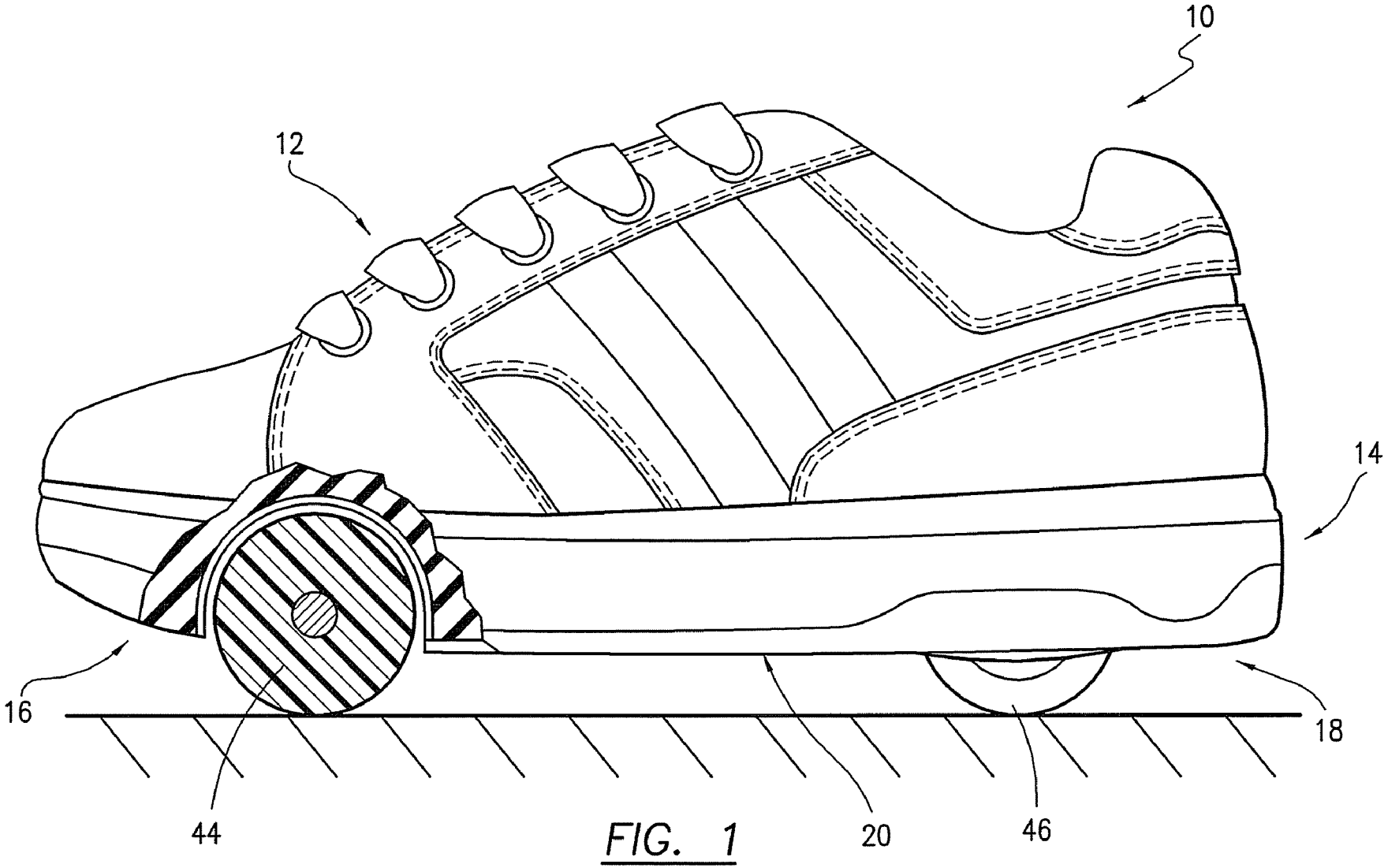
FIG. 1 is a side elevational view of a shoe with the removable rollers and strap of this invention.

Referring now to the Figs., a shoe 10 is depicted having an upper 12 connected to an outsole 14. It should be understood that other articles of footwear may be employed, and the one shown in the Figs. is only for purposes of illustration. The shoe 10 has a toe area 16, a heel area 18 and an arch area 20 located between the toe and heel areas 16, 18. The toe area 16 is formed with a cavity 22, and the heel area 18 is formed with a cavity 24. In one presently preferred embodiment, a recess 26 is formed in the outsole 14 which extends from its bottom surface 28 toward the upper 12 and in between the cavities 22 and 24. The recess 26 may include opposed, inwardly extending projections 30 and 32, a first locking tab 34 located adjacent to the cavity 22 and a second locking tab 36 adjacent to the cavity 24.

Figure 3:
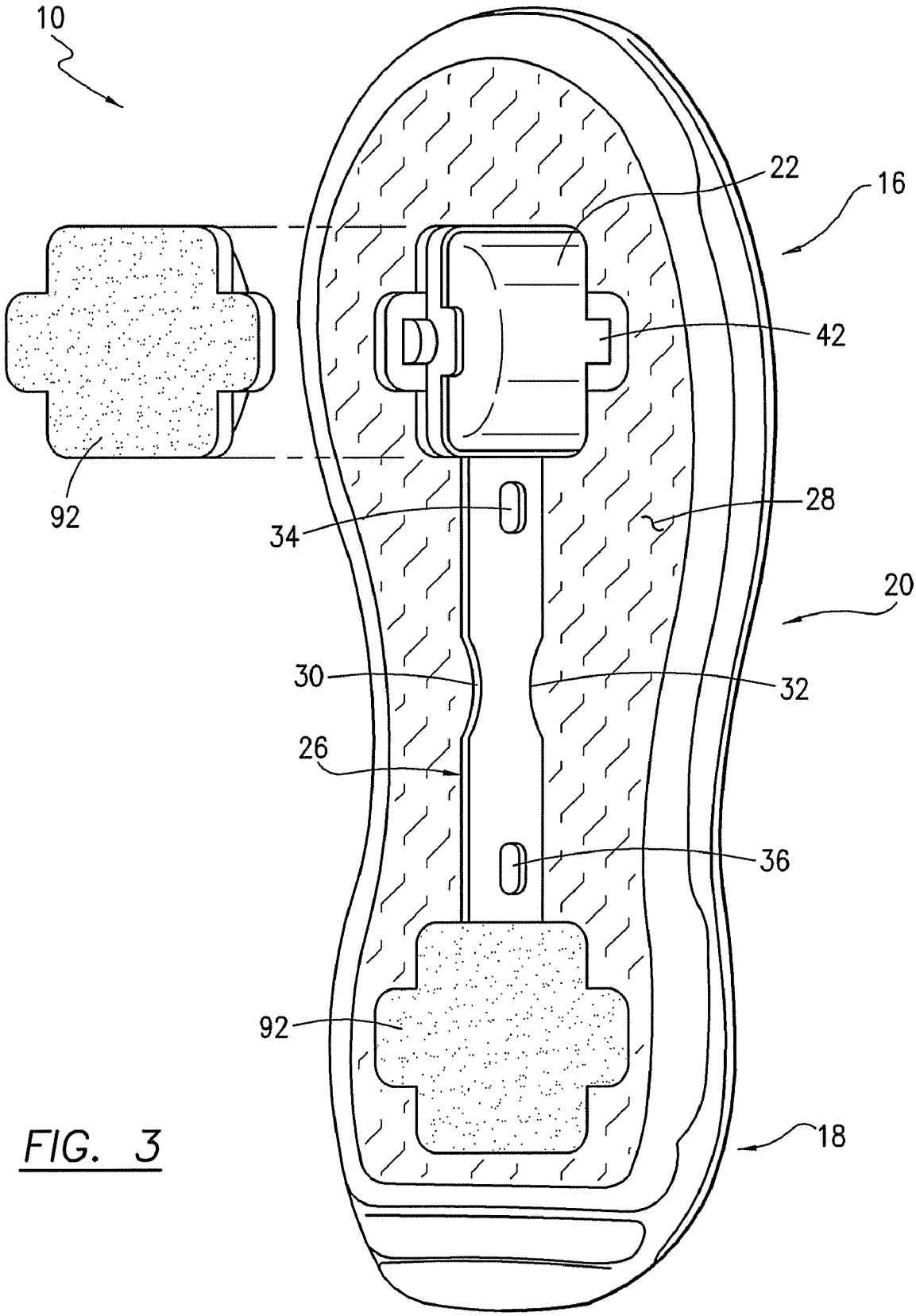
FIG. 3 is a view similar to FIG. 2 except with the rollers and strap removed from the shoe and a cap in place within one of the recesses.
Figure 5:
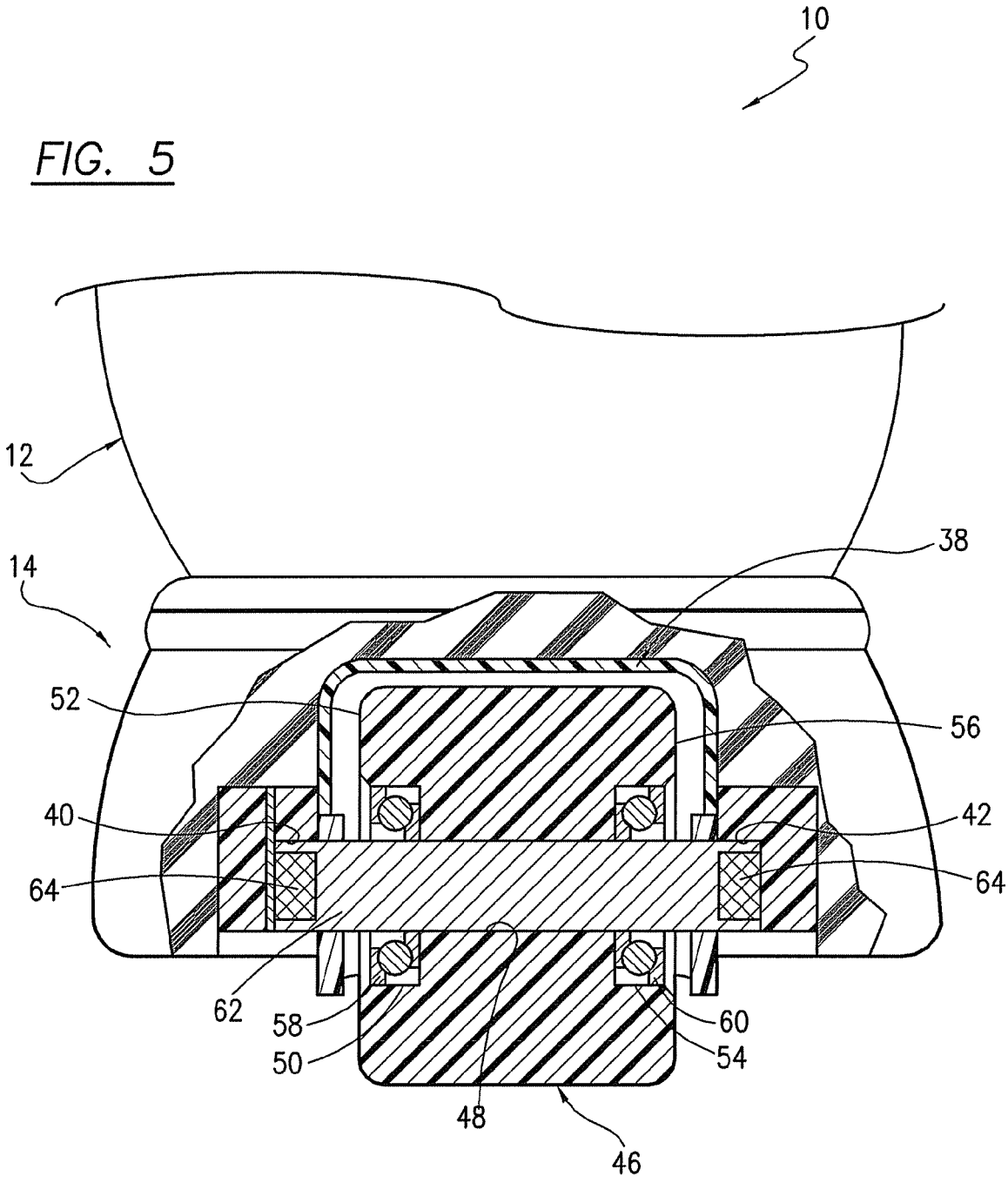
FIG. 5 is a cross sectional view of one of the rollers and the mount for the roller in the shoe outsole.

As best seen in FIGS. 3 and 5, each of the cavities 22 and 24 receives and permanently mounts a cup-shaped roller support 38 having opposed axle grooves 40 and 42. The roller supports 38, in turn, mount a roller 44 within the cavity 22 and a roller 46 within the cavity 24. Each of the rollers 44 and 46 is preferably formed of a wear resistant rubber-like material with a central through bore 48. A recess 50 is formed on one side 52 of the rollers 44, 46, and a recess 54 is formed on the opposite side 56, both of which are concentric to the through bore 48. Recess 50 mounts a bearing 58 and recess 54 mounts a bearing 60, which collectively couple a roller axle 62 to the respective rollers 44 and 46.

One end of the axle 62 of each roller 44 and 46 protrudes outwardly from the bearing 58, and its opposite end protrudes outwardly from the bearing 60. These ends of the axle 62 are received and mounted within the roller grooves 40, 42, respectively, of a roller support 38 to releasably secure the rollers 44 and 46 within respective cavities 22 and 24. In one presently preferred embodiment, the axle 62 of rollers 44 and 46 has a magnet 64 embedded within each end and the roller support 38 within each cavity 22, 24 is formed of a ferrous material so that the axle 62 is magnetically attracted to the roller support 38 to assist in retaining the rollers 44, 46 in place. Alternatively, the dimensions of the protruding ends of the axle 62 and mating 25 roller grooves 40, 42 in each roller support 38 are such that the axle 62 may be frictionally retained within the roller support 38, and, hence, the cavities 22 or 24. In either case, a portion of the rollers 44 and 46 extend into the respective cavities 22 and 24, and the remainder protrudes outwardly from the bottom surface 28 of the outsole 14 so that the rollers 44 and 46 can contact the ground or other surface for use of the shoe 10 as a roller shoe.

Figure 2:
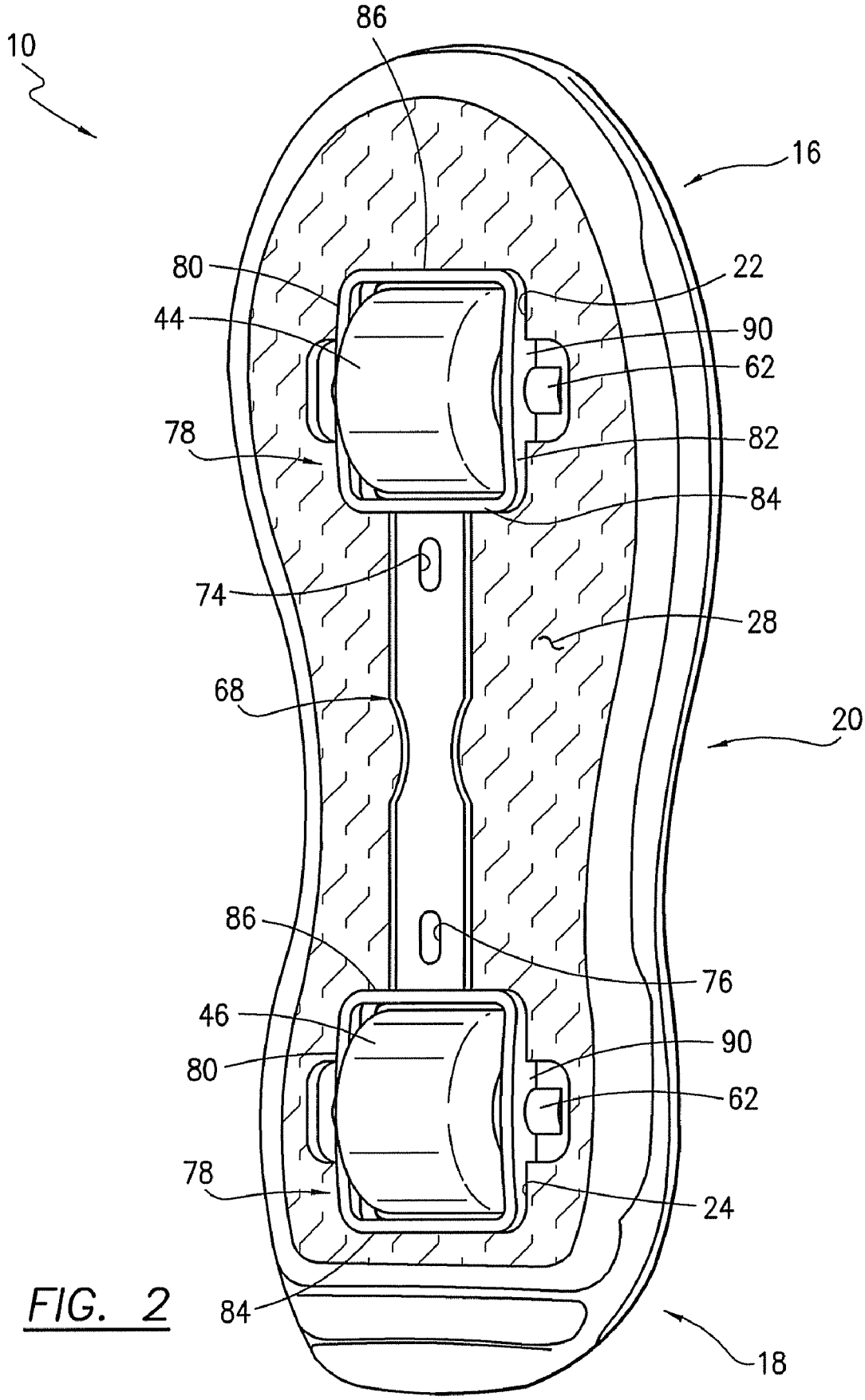
FIG. 2 is a bottom view of the shoe of FIG. 1 with the rollers and strap attached to the outsole of the shoe.
Figure 4:
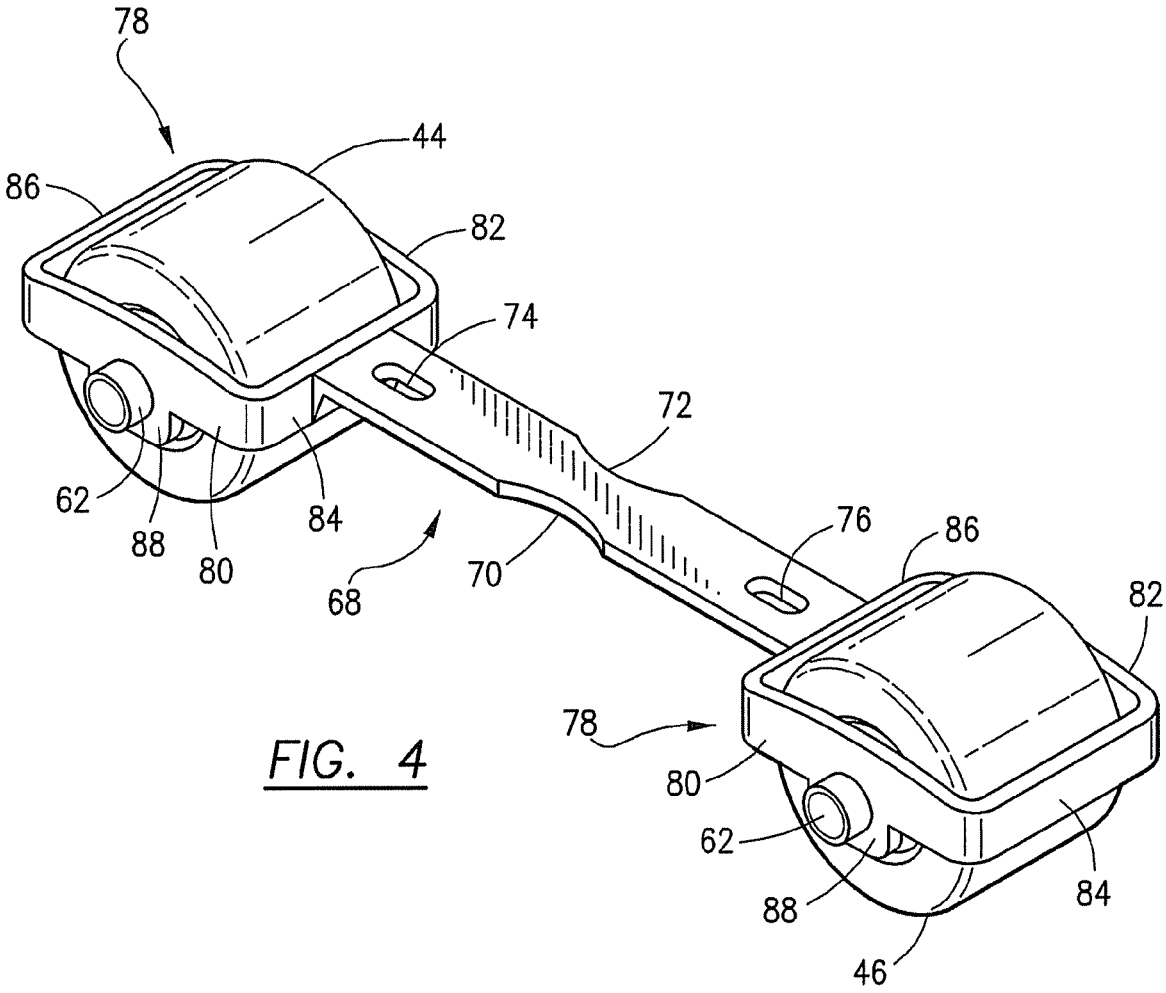
FIG. 4 is a perspective view of the two rollers connected to the strap.

Referring now to FIGS. 2 and 4, in the presently preferred embodiment the rollers 44 and 46 are connected to one another by a strap 68. The strap 68 may be formed of leather, plastic or other suitable material. The strap 68 is dimensioned to fit within the recess 26 formed in the outsole 14, and has opposed indentations 70 and 72 which receive the projections 30 and 32 extending into the recess 26. Additionally, the strap 68 is formed with openings 74 and 76 within which the locking tabs 34 and 36, respectively, snap-fit. Collectively, the indentations 70, 72, projections 30, 32, openings 74, 76 and locking tabs 34, 36 cooperate to retain the strap 68 in place within the recess 26.

Each end of the strap 68 is formed with a coupler 78 to connect the strap 68 to rollers 44 and 46. Each coupler 78 comprises a first arm 80, a second arm 82, a first spacer 84 extending from the strap 68 and connected between one end of the two arms 76, 78, and, a second spacer 86 connected between the opposite end of the arms 80, 82. In essence, each coupler 78 forms a square surrounding one of the rollers 44, 46. The coupler 78 is connected to a roller 44 or 46 by inserting the one end of axle 62 through a bore formed in an enlarged portion 88 of the first arm 80, and by inserting the other end of axle 62 through a bore formed in an enlarged area 90 of the second arm 82. The coupler 78 is dimensioned so as not to interfere with the rolling movement of rollers 44, 46, while remaining secured affixed thereto.

With the rollers 44 and 46 in place within respective cavities 22 and 24, and the strap 68 located within the recess 26, the shoe 10 is configured to function as a roller skate. In order to covert the shoe 10 for use as a walking or running shoe, the rollers 44 and 46 are removed with the strap 68 as a unit from the shoe outsole 14. The strap 68 assists in detaching the rollers 44 and 46 from their respective cavities 22 and 24, and retains the rollers 44, 46 together once they are removed from the shoe 10 so that they are not lost or misplaced. Preferably, a cap 92 may be placed over each of the cavities 22 and 24, and, optionally, the recess 26 may be provided with a cap (not shown) to prevent dirt or other debris from entering same when the rollers 44, 46 and strap 68 are removed. The caps 92 are removed and the rollers 44, 46 and strap 68 is inserted back in place in the outsole 14, to convert the shoe 10 back to use as a roller skate.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, the strap 68 is depicted as being received within a recess 26 formed in the outsole 14 of the shoe 10. It should be understood that the recess 26 may be eliminated and the strap 68 may rest directly against the bottom surface 28 of the outsole 14. Further, it is contemplated that in the event the recess 26 is employed, other means of affixing the strap 68 within the recess 26 could be employed such as merely a friction fit between the strap 68 and recess 26 thus eliminating the locking tabs 34, 36 protruding from the recess 26 and the openings 74, 76 in the strap 68.

Therefore, it is intended that the invention not be limited to the particular embodiment disclosed as the best mode contemplated for carrying out this invention, but that the invention will include all embodiments falling within the scope of the appended claims.

What is claimed is:

1. An article of footwear, comprising:

an outsole and an upper connected to said outsole, said outsole having a toe area, a heel area spaced from said toe area and a bottom surface, said toe area being formed with a first cavity, said heel area being formed with a second cavity, said outsole being formed with a recess extending from said bottom surface toward said upper in between said first and second cavities;

a first roller removably mounted within said first cavity, said first roller being coupled to a first axle having opposed ends each protruding from one side of said first roller;

a second roller removably mounted within said second cavity, said second roller being coupled to a second axle having opposed ends each protruding from one side of said second roller;

a strap having a first coupler which mounts to each of said opposed ends of said first axle and a second coupler which mounts to each of said opposed ends of said second axle, said strap being received within said recess.

2. The article of footwear of claim 1 in which said outsole is formed with at least one projection within said recess.

3. The article of footwear of claim 2 in which said strap is formed with at least one opening, said strap being positioned within said recess such that said at least one projection is insertable within said at least one opening to releasably retain said strap within said recess.

4. The article of footwear of claim 1 in which said recess in said outsole is dimensioned to frictionally engage said strap so that said strap is releasably retained within said recess.

5. The article of footwear of claim 1 in which said outsole is formed with at least one first mounting element within said recess and said strap is formed with at least one second mounting element, said first and second mounting elements being effective to engage one another to releasably retain said strap within said recess.

6. The article of footwear of claim 1 in which each of said first and second couplers comprises a first arm, a second arm, a first spacer connected between one end of said first and second arms and a second spacer connected between an opposite end of said first and second arms, said first arm being coupled to one end of said first or second axle and said second arm being coupled to the other end of said first or second axle.

7. The article of footwear of claim 6 in which each of said first and second arms is formed with a bore which receives respective first and second ends of said at least one axle.

8. The article of footwear of claim 1 further comprising at least one cover removably attached over said first cavity and said second cavity when said first and second rollers are removed from said outsole.

9. The article of footwear of claim 8 in which said at least one cover is a first cap removably attached over said first cavity and a second cap removably attached over said second cavity.

* * * * *